US008177329B2

(12) United States Patent
Matsumoto et al.

(10) Patent No.: US 8,177,329 B2
(45) Date of Patent: May 15, 2012

(54) INK JET PRINT HEAD

(75) Inventors: Mitsuhiro Matsumoto, Yokohama (JP); Mineo Kaneko, Tokyo (JP); Ken Tsuchii, Sagamihara (JP); Toru Yamane, Yokohama (JP); Masaki Oikawa, Inagi (JP); Keiji Tomizawa, Yokohama (JP); Shuichi Ide, Tokyo (JP); Kansui Takino, Kawasaki (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 260 days.

(21) Appl. No.: 12/752,773

(22) Filed: Apr. 1, 2010

(65) Prior Publication Data

US 2010/0188465 A1 Jul. 29, 2010

Related U.S. Application Data

(62) Division of application No. 12/195,892, filed on Aug. 21, 2008, now Pat. No. 7,735,962.

(30) Foreign Application Priority Data

Aug. 31, 2007 (JP) ..... 2007-225812
Jul. 25, 2008 (JP) ..... 2008-192227

(51) Int. Cl.
*B41J 2/15* (2006.01)
*B41J 2/145* (2006.01)

(52) U.S. Cl. ..... 347/40; 347/47

(58) Field of Classification Search ..... 347/15, 347/20, 40–43, 47
See application file for complete search history.

(56) References Cited

U.S. PATENT DOCUMENTS

| | | | | |
|---|---|---|---|---|
| 6,151,045 | A * | 11/2000 | Beach et al. | 347/45 |
| 6,575,560 | B2 | 6/2003 | Kaneko et al. | |
| 6,830,317 | B2 | 12/2004 | Tsuchii et al. | |
| 6,964,467 | B2 | 11/2005 | Kaneko et al. | |
| 6,971,736 | B2 | 12/2005 | Tomizawa et al. | |
| 6,976,748 | B2 | 12/2005 | Yabe et al. | |
| 6,984,026 | B2 | 1/2006 | Tomizawa et al. | |
| 7,387,371 | B2 | 6/2008 | Oikawa | |
| 7,399,060 | B2 | 7/2008 | Tsuchii | |
| 2002/0001015 | A1 | 1/2002 | Kojima et al. | |
| 2004/0218007 | A1 | 11/2004 | Tomizawa et al. | |
| 2007/0035580 | A1 | 2/2007 | Ide et al. | |
| 2007/0206065 | A1 | 9/2007 | Tomizawa et al. | |

(Continued)

FOREIGN PATENT DOCUMENTS

JP 2004-42651 A 2/2004

(Continued)

*Primary Examiner* — Thinh Nguyen
(74) *Attorney, Agent, or Firm* — Fitzpatrick, Cella, Harper & Scinto

(57) ABSTRACT

An object of the present invention is to provide an ink jet print head having plural types of nozzles arranged on the same substrate and through which ink droplets of different sizes are ejected, the ink jet print head exhibiting acceptable ejection performance regardless of the type of the nozzle. Thus, according to the present invention, each of the plural types of nozzles includes a bubbling chamber having an ejection energy generating element allowing an ink droplet to be ejected to a position located opposite an ejection port and an ejection port portion allowing the ejection port and the bubbling chamber to communicate with each other. Ratio of opening area of the ejection port portion at a position where the ejection port portion and the bubbling chamber communicate with each other, to the opening area of the ejection port is higher for the nozzle with a smaller ejection amount.

5 Claims, 15 Drawing Sheets

U.S. PATENT DOCUMENTS

| | | | |
|---|---|---|---|
| 2008/0001994 | A1 | 1/2008 | Kaneko |
| 2008/0111868 | A1 | 5/2008 | Yamane |
| 2008/0143786 | A1 | 6/2008 | Oikawa et al. |
| 2008/0239011 | A1 | 10/2008 | Ide et al. |
| 2009/0040273 | A1 | 2/2009 | Tsuchii et al. |
| 2009/0058934 | A1 | 3/2009 | Matsumoto |
| 2009/0058949 | A1 | 3/2009 | Tomizawa et al. |
| 2009/0066752 | A1 | 3/2009 | Ide et al. |
| 2009/0066753 | A1 | 3/2009 | Matsumoto |
| 2009/0147056 | A1 | 6/2009 | Oikawa et al. |

FOREIGN PATENT DOCUMENTS

| | | | |
|---|---|---|---|
| JP | 2004-42652 | A | 2/2004 |

* cited by examiner

INK JET PRINT HEAD

This is a division of U.S. patent application Ser. No. 12/195,892 filed Aug. 21, 2008.

BACKGROUND OF THE INVENTION

1. Field of the Invention

The present invention relates to an ink jet print head that ejects ink droplets to print a print medium, and in particular, to an ink jet print head having a plurality of types of nozzles arranged on the same substrate and through which ink droplets of different sizes are ejected.

2. Description of the Related Art

With the increased operating speed of ink jet printing apparatuses and improved image quality provided by the ink jet printing apparatuses, attempts have been made to reduce the size of droplets ejected by print heads while increasing ejection frequency.

A reduction in the size of ejected droplets requires a reduction in the opening area of each ejection port in the print head. However, the reduced opening area of the ejection port may increase the flow resistance to a liquid in a portion (ejection port portion) that communicates with the ejection port, preventing desired ejection performance and efficiency from being achieved. Thus, ink jet print heads disclosed in Japanese Patent Laid-Open Nos. 2004-042651 and 2004-042652 serve to reduce the flow resistance of the ejection port portion while maintaining the strength of an ejection port forming portion.

Each of the print heads disclosed in Japanese Patent Laid-Open Nos. 2004-042651 and 2004-042652 has a plurality of nozzles through which ink flows. Each of the nozzles has a bubbling chamber 38 that boils ink to generate bubbles and an ejection port portion 36 including an ejection port 37 that is a tip opening of the nozzle through which ink droplets are ejected, as shown in FIG. 15. The ejection port portion 36 allows the ejection port 37 and the bubbling chamber 38 to communicate with each other and is made up of a first ejection port portion 36*a* and a second ejection port portion 36*b* which communicate with the ejection port 37. The first ejection port portion 36*a* and the second ejection port portion 36*b* constitute a cylindrical space centered around a central axis passing through the center of an electrothermal conversion element 34 and orthogonally to a major surface 32*a* of an element substrate 32. When the second ejection port portion 36*b* is cut in a direction parallel to the major surface 32*a*, the resulting opening of the second ejection port portion 36*b* is located outside the opening of the first ejection port portion 36*a* cut in the same direction and inside a cross-section of the bubbling chamber in the same direction. That is, the second ejection port 36*b* corresponds to a space formed by enlarging the first ejection port 36*a* in a plane direction.

In the ink jet print head 30 configured as described above, the thickness of the first ejection port portion 36*a* ensures the strength of a peripheral portion of the ejection port 37. Furthermore, the enlarged space of the second ejection port 36*b* enables a reduction in the flow resistance of the whole ejection port portion. Thus, even if the nozzle is provided with an ejection port having a small diameter and through which small droplets are ejected, a possible pressure loss in the ejection port portion 36 can be reduced. Furthermore, bubbles can be grown in an ejection direction. As a result, ink droplets can be efficiently ejected.

Such a reduction in the size of ejected droplets enables a reduction in the size of dots constituting an image and in the sense of granularity conveyed by the image. Thus, the droplet size reduction significantly contributes to improving image quality. However, the droplet size reduction has also been found to be disadvantageous in terms of costs, print speed, thermal efficiency, and the like. That is, when the entire area of the image is formed of small dots in order to reduce the sense of granularity, the number of data in the image increases sharply. This tends to increase the scales of drivers and circuits and thus costs. Furthermore, an increase in nozzle length or chip count for high-speed printing also increases the costs. Moreover, to use small dots to achieve a print speed equivalent to that at which an image is formed using large dots, a nozzle driving frequency needs to be increased compared to that required for printing using the large dots. That is, the number of dots formed per unit time needs to be increased. Thus, the thermal efficiency of a printing operation tends to decrease.

Thus, to solve these problems, a technique has been proposed which provides a plurality of types of nozzles through which ink droplets of different sizes are ejected, on the same head substrate so that one of the plural types of nozzles is selected for use depending on the density of the image. For example, a printing method has been proposed which forms small dots using small ink droplets for a low density portion and an intermediate density portion of the image, while forming large dots using large ink droplets for the intermediate density portion and a high density portion of the image. In this case, if two types of droplet sizes, that is, large and small droplet sizes, are available and the ratio of the large dot to the small dot is about 2 to 4:1, a clear image can be printed by connecting the large and small dots together from the low density portion to the high density portion according to the resolution of the image. Thus, one of the dot sizes is selected for formation depending on the density of the image to be printed. This enables the image to be quickly and efficiently formed, allowing the thermal efficiency of the printing operation to be improved.

However, for the conventional print head, which has the plural types of nozzles of different sizes, each having the ejection port portion composed of the first ejection port portion and the second ejection port portion as described above, ejection characteristics may disadvantageously be unbalanced among the nozzles.

This is because in the conventional print head, the ratio of the opening area of the ejection port to the opening area of the opening of the second ejection port portion is fixed regardless of the size of the ejection port. That is, the nozzle through which smaller ink droplets are ejected suffers a more significant variation in the rate of a pressure loss during ejection in connection with a manufacturing error (misalignment at the boundary portion between the first ejection port portion 36*a* and the second ejection port portion 36*b*) in the ejection port portion. This is likely to affect ejection performance such as the amount of ink droplets and landing accuracy. Thus, a possible manufacturing error as described above unbalances the ejection performance between the nozzle with the large ejection port and the nozzle with the small ejection port. This may in turn degrade the quality of images formed using a combination of the large and small dots.

Furthermore, the current ink jet printing apparatus has a suction recovery mechanism that forcibly sucks and discharges thickened ink in the nozzle and bubbles mixed into the ink, through the ejection port to recover the ejection performance of the nozzle. However, a possible manufacturing variation as described above sharply increases the flow resistance to the ink in the small ejection port portion, through which small ink droplets are ejected. Consequently, the suction recovery capability may be degraded, that is, old ink in the nozzle cannot be sufficiently discharged. Namely, for the conventional print head, the nozzle through which smaller ink droplets are ejected is more likely to suffer degradation of the suction recovery capability. This may also unbalance the ejection performance among the various nozzles, degrading the image quality.

SUMMARY OF THE INVENTION

An object of the present invention is to provide an ink jet print head having a plurality of types of nozzles arranged on the same substrate and through which ink droplets of different sizes are ejected, the ink jet print head exhibiting acceptable ejection performance regardless of the type of nozzle to enable high-quality images to be efficiently and quickly printed.

The present invention provides an ink jet print head having a plurality of types of nozzles arranged on the same substrate and through which ink droplets of different sizes are ejected. Each of the nozzles comprises a bubbling chamber having an ejection energy generating element allowing an ink droplet to be ejected to a position located opposite an ejection port and an ejection port portion allowing the ejection port and the bubbling chamber to communicate with each other, and the ratio of an opening area of the ejection port portion at a position where the ejection port portion and the bubbling chamber communicate with each other, to the opening area of the ejection port is higher for the nozzle with a smaller ejection amount.

According to the present invention, among the plurality of types of nozzles through which ink droplets of different sizes are ejected, even the nozzle through which small sized ink droplets are ejected can avoid being seriously affected by a manufacturing error in the ejection port portion. Therefore, the balance of the landing performance among the plural types of nozzles can be improved.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

First Embodiment

First, a first embodiment of the present invention will be described with reference to FIGS. 1, 2, 3A, 3B, and 3C.

Figure 1B:
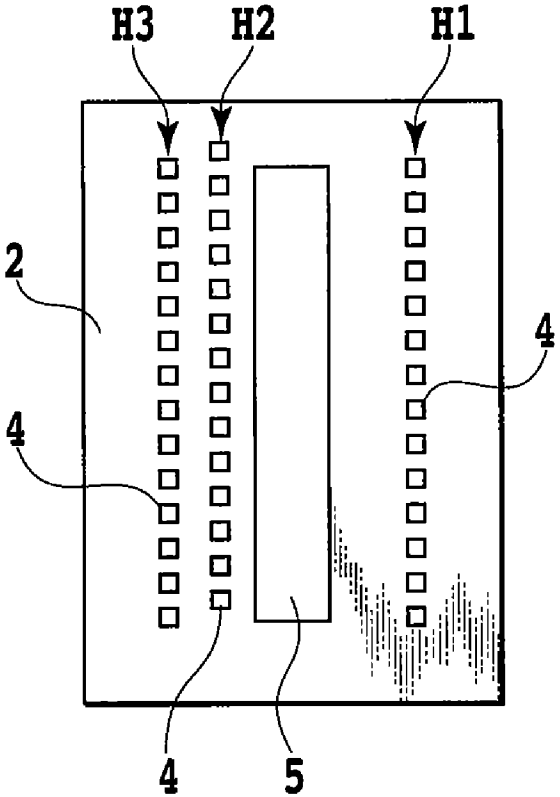
FIG. 1B is a bottom view schematically showing how electrothermal conversion elements 4 are arranged on a print element substrate shown in FIG. 1A.
Figure 1A:
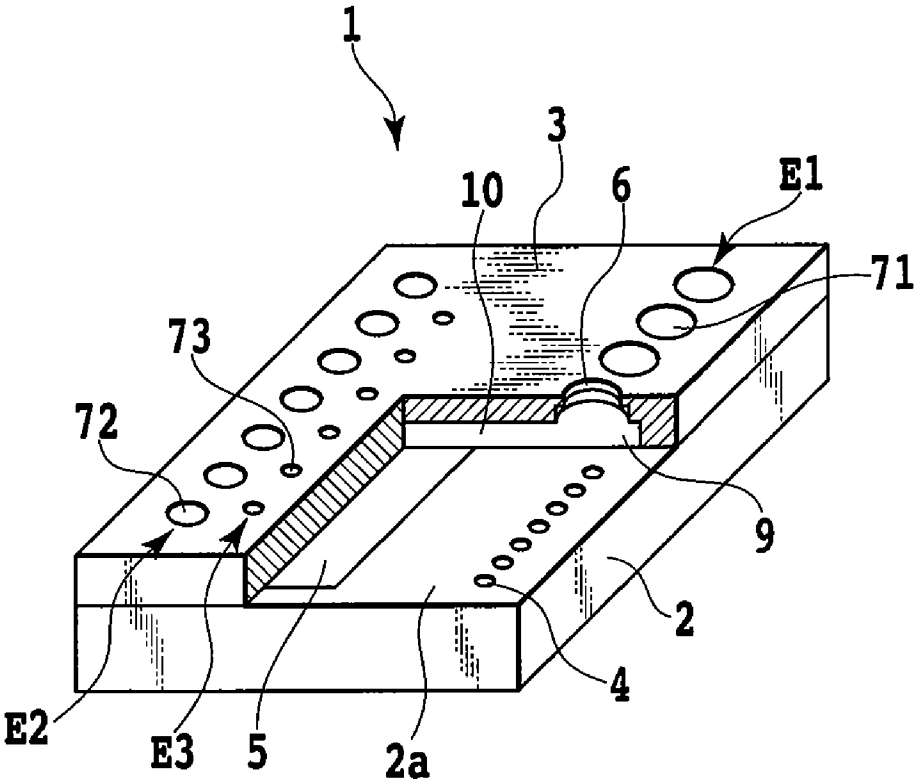
FIG. 1A is a partly cutaway perspective view schematically showing an ink jet print head 1 according to a first embodiment of the present invention.

FIG. 1A is a partly cutaway perspective view schematically showing an ink jet print head 1 according to the first embodiment. The ink jet print head 1 comprises an element substrate 2 having electrothermal conversion elements 4 as ejection energy generating elements and a channel constituting substrate (orifice plate) 3 stacked on a major surface 2*a* of the element substrate 2.

As shown in FIG. 1B, three print element arrays H1, H2, and H3 each made up of a plurality of electrothermal conversion elements 4 are arranged on the element substrate 2 parallel to one another. An ink supply port 5 is formed between the first print element array H1 and both the second and third print element arrays H2 and H3.

A plurality of ejection port portions 6, a plurality of bubbling chambers 9, and a plurality of ink supply channels 10 are formed in the channel constituting substrate 3; the plurality of ejection port portions 6 are provided opposite the respective electrothermal conversion elements 4 in each of the print element arrays H1, H2, and H3, the plurality of bubbling chambers 9 communicate with the respective ejection port portions 6, and the plurality of ink supply channels 10 communicate with the bubbling chambers 9. Each of the ejection port portions 6 has ejection ports 71, 72, and 73 each having an end that is open in one surface of the channel constituting substrate 3. The ejection ports 71, 72, and 73 are formed opposite the electrothermal conversion elements 4. Thus, the three ejection port arrays E1, E2, and E3 are formed on the element substrate 3. Of the three ejection port arrays E1, E2, and E3, the ejection port array E1 is hereinafter referred to as a first ejection port array, the ejection port array E2 is hereinafter referred to as a second ejection port array, and the ejection port array E3 is hereinafter referred to as a third ejection port array. A portion composed of the ejection port portion 6, the bubbling chamber 9, and the ink supply channel 10 is hereinafter referred to as a nozzle. The term "ink" as used herein is not limited to a predetermined coloring agent attached to a print medium to form an image but includes, for example, a transparent process liquid ejected from the print head before or after image formation in order to improve the coloring capability, weatherability, and the like of the image formed on the print medium.

In the print head with the plurality of nozzles formed therein as described above, an ink tank (not shown) is connected to the ink supply port 5 so that the ink in the ink tank is filled into the bubbling chamber 8 and the ejection port portion 6 via the ink supply channel 10 through the ink supply port 5. Here, when energized, the electrothermal conversion element 4 generates heat to instantly boil the ink in the bubbling chamber 8. This rapid change of the ink from a liquid phase to a vapor phase rapidly increases the pressure in the bubbling chamber 8 to allow ink droplets to be ejected through the ejection ports 71, 72, and 73 at a high speed. Thus, the ink jet print head 1 according to the present embodiment is of what is called a side shooter type in which the ink is ejected through the ejection ports 71, 72, and 73, formed parallel to the element substrate.

Figure 2:
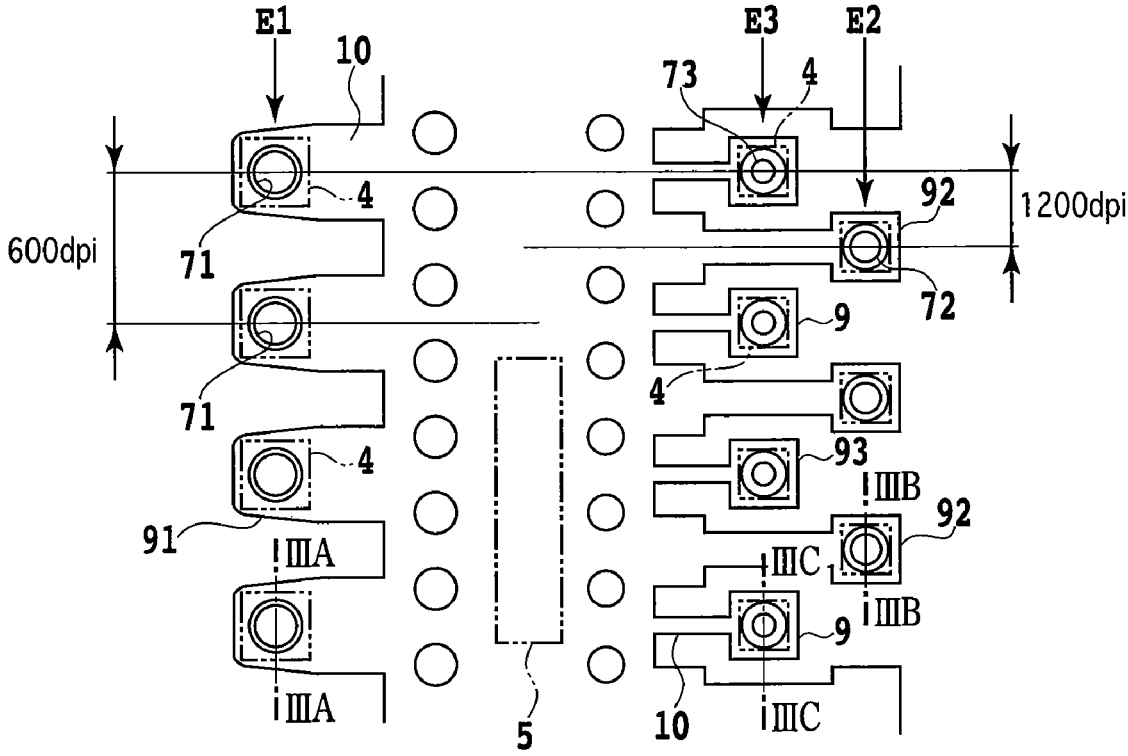
FIG. 2 is an enlarged bottom view showing a part of ejection port arrays on one side of the ink jet print head shown in FIG. 1A.

FIG. 2 is an enlarged bottom view of a part of the ejection port arrays on the ink jet print head according to the present embodiment. FIG. 2 shows the positional relationship among the bubbling chambers 9, the ink supply channels 10, the electrothermal conversion elements 4, and the ejection ports 71, 72, and 73. In FIG. 2, the first ejection port array E1 is composed of the ejection ports 71, having a larger opening area that of than the ejection ports 72 and 73 in the other ejection port arrays E2 and E3. Ink droplets (large ink droplets) having a size (liquid volume) larger than that of ink droplets from the other ejection ports 72 and 73 are ejected through the ejection ports 71. The nozzle through which the large ink droplets are ejected is hereinafter referred to as a large nozzle (first nozzle). The third ejection port array E3 is composed of the ejection ports 73, having a smaller opening area than that of the ejection ports 71 and 72 in the other ejection port arrays E1 and E2. Ink droplets (small ink droplets) having a size (liquid volume) smaller than that of ink droplets from the other ejection ports 71 and 72 are ejected through the ejection ports 73. The nozzle through which the small ink droplets are ejected is hereinafter referred to as a small nozzle (third nozzle). The second ejection port array E2 is composed of the ejection ports 72, having an opening area smaller than that of the ejection port 71 and larger than that of the ejection port 73. Ink droplets (medium ink droplets) with a size (liquid volume) smaller than that of ink droplets from the ejection port 71 and larger than that of ink droplets from the ejection port 73 are ejected through the ejection ports 72. The nozzle through which the medium ink droplets are ejected is hereinafter referred to as a medium nozzle (second nozzle). The ejection ports 71, 73, and 72 are hereinafter also referred to as a large ejection port, a small ejection port, and a medium ejection port, respectively.

In the present embodiment, the large ejection ports 71, constituting the first ejection port array E1, are arranged at intervals of 600 dpi. Similarly, the medium ejection ports 72 in the second ejection port array E2 and the small ejection port array 73 are arranged at intervals of 1,200 dpi. However, each of the ejection ports (medium ejection ports) 72 in the second ejection port array E2 is displaced from the corresponding one of the ejection ports (small ejection ports) in the third ejection port array E3 by a distance corresponding to 1,200 dpi. That is, the distance between the medium ejection port 72 and the small ejection port 73 adjacent to each other in an ejection port arrangement direction are arranged corresponds to 1,200 dpi. The ratio of the liquid volumes of ink droplets ejected through the large, medium, and small ejection ports 71, 72, and 73 is determined by the pitch of the ejection ports and an area factor during image formation. Desirably, the ratio of the liquid volume of large ink droplets to the liquid volume of medium ink droplets and the ratio of the liquid volume of medium ink droplets to the liquid volume of small ink droplets are each about 2 to 4.

Figure 3C:
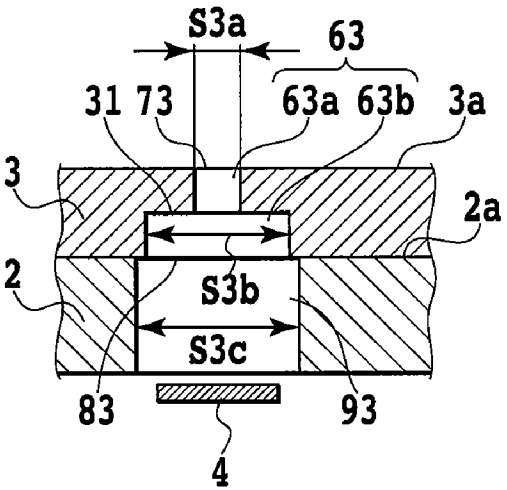
FIG. 3C is a sectional view of a small ejection port shown in FIG. 2, the view being taken along line IIIC-IIIC in FIG. 2.
Figure 3B:
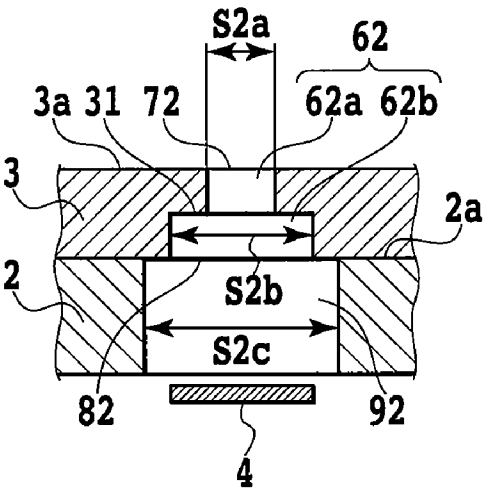
FIG. 3B is a sectional view of a medium ejection port shown in FIG. 2, the view being taken along line IIIB-IIIB in FIG. 2.
Figure 3A:
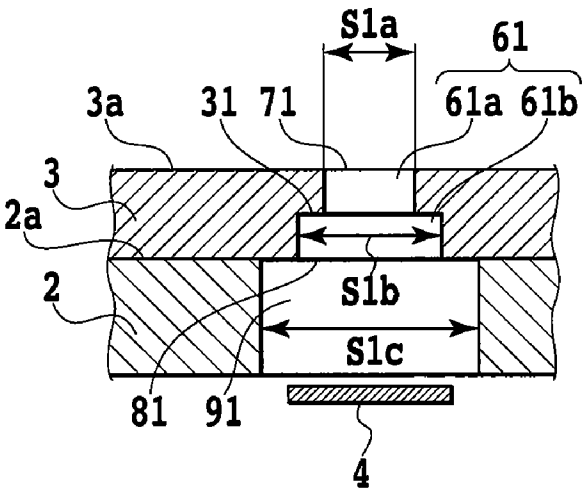
FIG. 3A is a sectional view of a large ejection port shown in FIG. 2, the view being taken along line IIIA-IIIA in FIG. 2.

FIG. 3A is a sectional view of the large ejection port shown in FIG. 2, the view being taken along line IIIA-IIIA in FIG. 2. FIG. 3B is a sectional view of the medium ejection port shown in FIG. 2, the view being taken along line IIIB-IIIB in FIG. 2. FIG. 3C is a sectional view of the small ejection port shown in FIG. 2, the view being taken along line IIIC-IIIC in FIG. 2.

In FIGS. 3A, 3B, and 3C, reference numerals 61, 62, and 63 denote three types of ejection port portions that communicate with the ejection ports 71, 72, and 73, formed in the channel constituting substrate 3. Reference numerals 91, 92, and 93 denote bubbling chambers that communicate with the respective ejection port portions. In FIG. 1A, the ejection port portions and bubbling chambers are collectively shown as the ejection port portion 6 and the bubbling chamber 9, respectively. However, here, the ejection ports and bubbling chambers are denoted by the different reference numerals owing to the need to distinguish the ejection port portions from one another.

In FIG. 3A, a first ejection port portion 61*a* and a second ejection port portion 61*b* are formed in the ejection port portion 61; the large ejection port 71 is formed at a first end of the first ejection port 61*a*, and the second ejection port portion 61*b* communicates with the bubbling chamber 91, having a first end communicating with a second end of the first ejection port portion 61*a* and a second end communicating with the bubbling chamber 91, formed at an end of the ink supply channel 10. In the channel constituting substrate 3, a surface 3*a* in which the large ejection port 71 is formed is parallel to the major surface 2*a* of the element substrate. The center of the large ejection port 71 coincides with an axis (center axis) orthogonal to the major surface 2*a* of the element substrate and passing through the center of the heating element 4.

Each of the first ejection port portion 61*a* and the second ejection port portion 61*b* forms a cylindrical space centered on the center axis. The opening area S1*a* of the large ejection port 71, formed at the first end of the first ejection port portion 61*a*, is larger than that S1*b* of an opening 81 formed at the second end of the second ejection port portion 61*b*. Thus, a step portion 31 is formed on an inner surface of the ejection port portion 61 at the boundary portion between the first ejection port portion 61*a* and the second ejection port portion 61*b*. That is, in the present embodiment, the inner surface of the ejection port 61 is formed like a step.

The first ejection port portion 61 has been described. Similarly, in the second ejection port portion 62, a first ejection port portion 62*a* and a second port portion 62*b* forming a cylindrical space are formed, and in the third ejection port portion 63, a first ejection port portion 63*a* and a second port portion 63*b* forming a cylindrical space are formed. In each case, the step portion 31 is formed at the coupling portion between the first ejection port portion and the second ejection port portion.

In the present embodiment, the liquid volume (first liquid volume) Va of large ink droplets is 2.8 ng, the liquid volume (second liquid volume) Vb of medium ink droplets is 1.4 ng, and the liquid volume (third liquid volume) Vc of small ink droplets is 0.7 ng. The opening areas S1*a*, S2*a*, and S1*a* of the first, second, and third ejection ports 71, 72, and 73 are about 120 $um^2$, about 60 $um^2$, and about 30 $um^2$, respectively. Moreover, the ratio of the opening area S1*b* of the opening 81 of the second ejection port portion to the opening area of the ejection port 71 is S1*b*/S1*a*=2.5. The ratio of the opening area S2*b* of the opening 82 of the second ejection port portion to the opening area of the ejection port 72 is S2*b*/S2*a*=3.6. The ratio of the opening area S1*b* of the opening 83 of the second ejection port portion to the opening area of the ejection port 73 is S3*b*/S3*a*=6.3. That is, the magnitude correlation between the ratios of the opening areas of the second ejection port portions to the opening areas of the ejection ports are as follows:

$$S1b/S1a<S2b/S2a<S3b/S3a \quad \text{(Formula 1)}$$

The widths of the bubbling chambers 91, 92, and 93, communicating with the ejection port portions 71, 72, and 73, are denoted by S1*c*, S2*c*, and S3*c*. The relationship between S1*c* and S2*c* and S3*c* is S1*c*>S2*c*>S3*c*. However, the bubbling chambers 91, 92, and 93 have the same height.

Thus, in the present embodiment, the ratio of the opening area of the second ejection port portion to the opening area of the ejection port is higher for the ejection port portion having the ejection port with the smaller opening area. This is because if the ratio of the opening area of the second ejection port portion to the opening area of the ejection port is the same for the ejection port portion through which the large ink droplets are ejected and for the ejection port portion through which the small ink droplets are ejected, only the landing accuracy of the small ink droplets may decrease. That is, the small ink droplets ejected through the ejection port with the smaller opening area are more likely to be affected by air resistance or the flow resistance to the ink resulting from an alignment error during manufacture. Thus, for the ejection port portion having the ejection port with the smaller opening area, the ratio of the opening area of the second ejection port portion to the opening area of the ejection port is increased to sharply reduce the possible flow resistance in the ejection port portion. This enables a further reduction in the loss of the pressure on the ink during ejection and also allows old ink in the nozzles to be positively ejected through the large, medium, and small ejection ports during the suction recovery operation. This in turn enables prevention of inappropriate ejection from the nozzles and degradation of the ejection performance. Thus, for the nozzles through which the medium and small ink droplets are ejected, appropriate ink droplet ejection characteristics can be maintained with the adverse effects of alignment errors inhibited. This enables a drastic reduction of variation in ink droplet landing accuracy among the various nozzles. Therefore, the present embodiment allows high-quality images to be quickly and efficiently printed by combining the large, medium, and small droplets together. The present embodiment also forms the first and second ejection port portions to enable the thickness of the whole ejection port portion to be kept at a value required to maintain the appropriate physical strength of the ejection port portion.

Second Embodiment

Now, a second embodiment of the present invention will be described.

Figure 4:
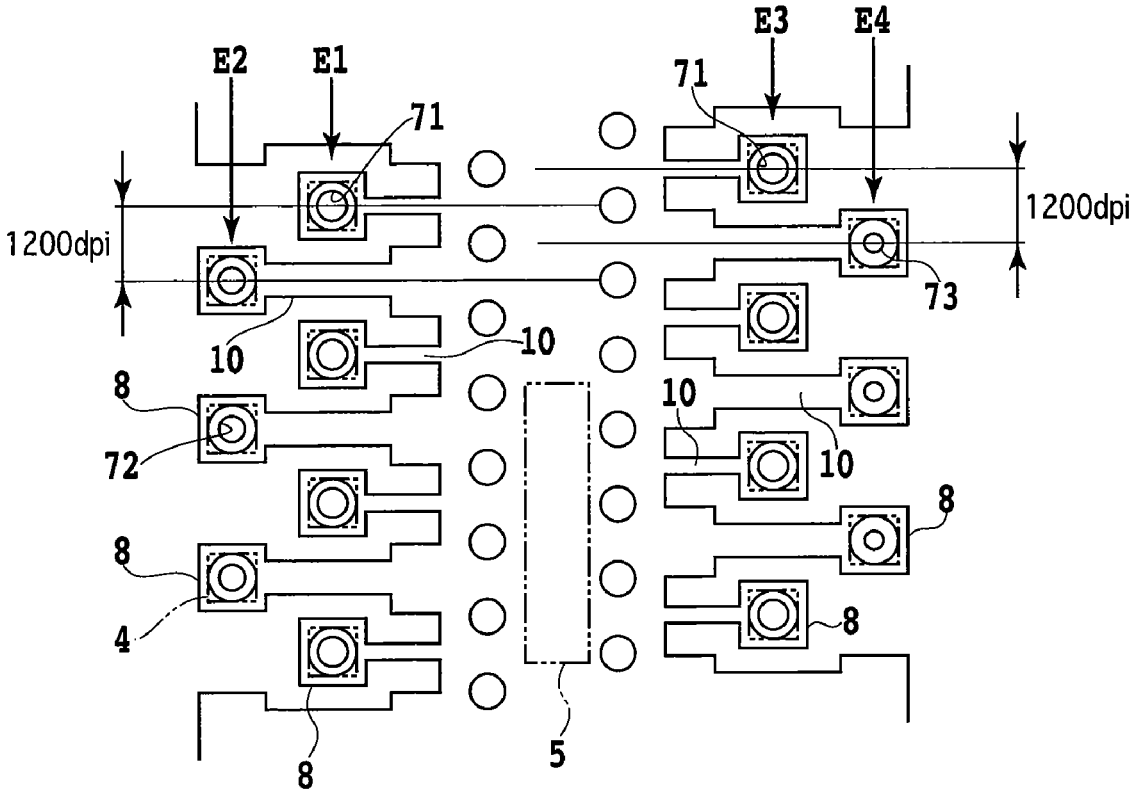
FIG. 4 is an enlarged bottom view showing a part of an ejection port array in an ink jet print head according to a second embodiment of the present invention.
Figure 5:
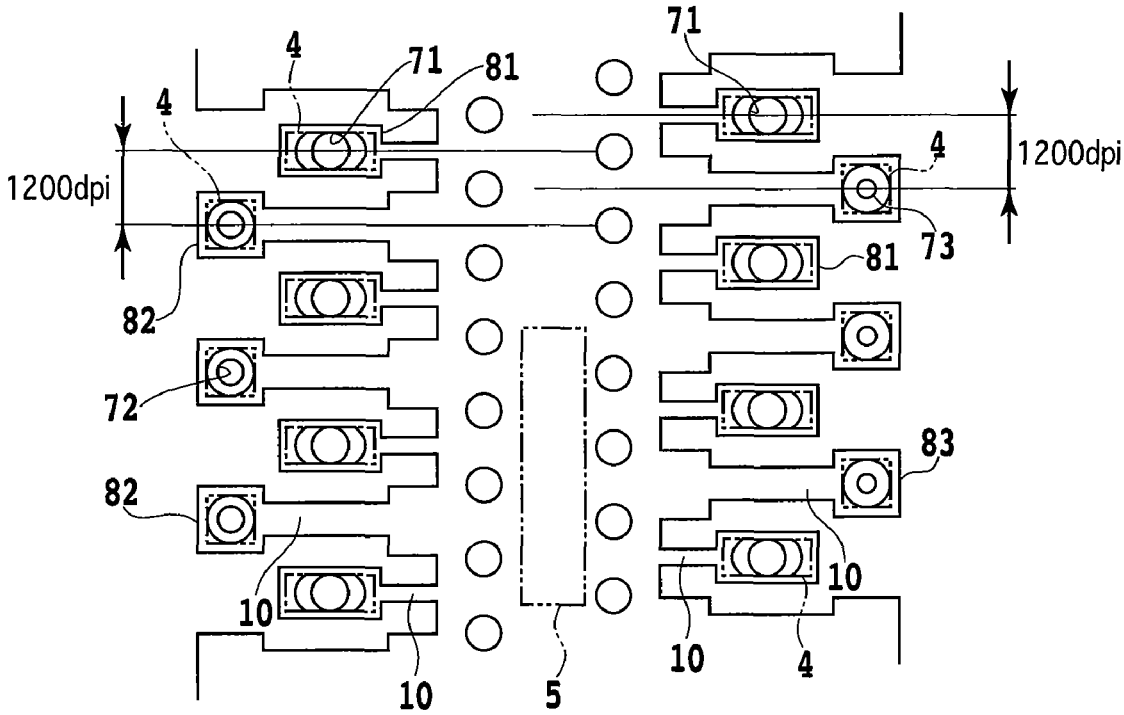
FIG. 5 is an enlarged bottom view showing a part of an ejection port array in an ink jet print head according to a third embodiment of the present invention.

FIG. 4 is a bottom view of a part of ejection port arrays in an ink jet print head according to the second embodiment. FIG. 4 shows the positional relationship among the bubbling chambers 9, the ink supply channels 10, the electrothermal conversion elements 4, and the ejection ports 71, 72, and 73. In the second embodiment, the four ejection port arrays E1, E2, E3, and E4 are arranged parallel to one another. The first and second ejection port arrays E1 and E2 are arranged on one side (in the figure, on the left side) of the ink supply port 5. The third and fourth ejection port arrays E3 and E4 are arranged on the other side (in the figure, on the right side) of the ink supply port 5. Each of the first and third ejection port arrays E1 and E3 is composed of the large ejection ports 71, shown in FIG. 3A. The second ejection port array E2 is composed of the medium ejection ports 72, shown in FIG. 3B. The fourth ejection port array E4 is composed of the small ejection ports 73, shown in FIG. 3C.

In the second embodiment, the ejection port arrays are arranged at intervals of 600 dpi. For the large ejection ports 71 constituting the first ejection port array E1 and the medium ejection ports 72 constituting the second ejection port array E2, the distance between the large ejection port 71 and medium ejection port 72 adjacent to each other in the ejection port arrangement direction is 1,200 dpi. Moreover, for the large ejection ports 71 constituting the third ejection port array E3 and small ejection ports 73 constituting the fourth ejection port array E4, the distance between the large ejection port 71 and small ejection port 73 adjacent to each other in the ejection port arrangement direction is also 1,200 dpi.

In the second embodiment, the liquid volumes of the large, medium, and small ink droplets are similar to those in the first embodiment. The opening areas of the first, second and third ejection ports 71, 72, and 73 are also similar to those in the first embodiment. Consequently, the ratios of the opening area of the second ejection port portion to the opening area of the ejection port, that is, S1*b*/S1*a*, S2*b*/S2*a*, and S3*b*/S3*a*, are 2.5, 3.6, and 6.3, respectively. That is, the magnitude correlation between the ratios of the opening area of the second ejection port portion to the opening area of the first ejection port portion is as follows:

$$S1b/S1a<S2b/S2a<S3b/S3a \quad \text{(Formula 1)}$$

That is, the ratio of the opening area of the second ejection port portion to the opening area of the ejection port increases with decreasing opening area of the ejection port. Thus, the nozzle through which the small ink droplets are ejected is unlikely to be affected by alignment errors and air resistance. Acceptable ink droplet ejection characteristics can thus be maintained. This enables a drastic reduction in variation in ink droplet landing accuracy among the various nozzles. Therefore, high-quality images can be quickly and efficiently printed by combining the large, medium, and small droplets together.

Third Embodiment

A third embodiment of the present invention will be described.

In the second embodiment, all the ejection port portions are cylindrical. However, the ejection port portions need not necessarily be cylindrical but may have another shape. In the third embodiment, each of the ejection port portions is formed to have an elliptic cross-section.

Also in the third embodiment, the liquid volumes Va, Vb, and Vc of large, medium, and small ink droplets are 2.8 ng, 1.4 ng, and 0.7 ng, respectively. The sectional areas S1*a*, S2*a*, and S1*a* of the ejection ports are about 120 $nm^2$, 60 $um^2$, and 30 $um^2$. The ratios of the opening area of the second ejection port portion to the opening area of the ejection port, that is, S1*b*/S1*a*, S2*b*/S2*a*, and S3*b*/S3*a*, are 3.1, 3.6, and 6.3, respectively.

Consequently, the magnitude correlation between the ratios of the opening area of the second ejection port portion to the opening area of the first ejection port portion is as follows:

$$S1b/S1a<S2b/S2a<S3b/S3a \quad \text{(Formula 1)}$$

Thus, the third embodiment also enables a drastic reduction in variation in ink droplet landing accuracy among the various nozzles. Therefore, high-quality images can be quickly and efficiently printed by combining the large, medium, and small droplets together.

Variation of the First to Third Embodiments

In the first to third embodiments, the values of the liquid volumes of ink droplets for the large, medium, and small dots, the opening areas of the ejection ports, and the like can be appropriately varied as long as the relationship in (Formula 1) is met.

For example, the liquid volumes Va, Vb, and Vc of large, medium, and small droplets can be set to 5 ng, 2 ng, and 0.7 ng, respectively, and the opening areas S1*a*, S2*a*, and S1*a* of the large, medium, and small ejection ports 71, 72, and 73 can be set to 200 $um^2$, 80 $um^2$, and 30 $um^2$, respectively. In this case, the ratios of the opening area of the second ejection port portion to the opening area of the first ejection port portion in each of the ejection port portions in each ejection port array, that is, S1*b*/S1*a*, S2*b*/S2*a*, and S3*b*/S3*a*, are set to 1.7, 2.9, and 6.25, respectively. This also meets the relationship in (Formula 1). The present embodiment is thus expected to exert effects similar to those of the first to third embodiments.

The liquid volumes Va, Vb, and Vc of large, medium, and small ink droplets may be set to 2 ng, 1 ng, and 0.5 ng, respectively, and the ratios of the opening area of the second ejection port portion to the opening area of the first ejection port portion in each of the ejection port portions, that is, S1*b*/S1*a*, S2*b*/S2*a*, and S3*b*/S3*a*, may be set to 2.9 to 3.7, 4.5, and 9.1, respectively. This also meets the relationship in (Formula 1). The present embodiment is thus expected to exert effects similar to those of the first to third embodiments.

In contrast, if with the nozzles through which the ink droplets of the different sizes, that is, the large, medium, and small ink droplets, are ejected, the liquid volumes for the ejection port portions do not meet the relationship in (Formula 1), effects similar to those of the above-described embodiments are not expected to be exerted. For example, it is assumed that for example, for three types of nozzles with liquid volumes Va, Vb, and Vc of 2.8 ng, 1.4 ng, and 0.7 ng, respectively, the ratios of the opening areas of the ejection port portions, S1*b*/S1*a*, S2*b*/S2*a*, and S3*b*/S3*a* are all 2.5. In this case, with an alignment error in the ejection port portions occurring during a manufacturing process, the nozzle with a smaller ejection amount suffers a larger amount of deviation of an landing position. For example, when the second ejection port portion and the first ejection port portion are misaligned by about 1 um, the amount of deviation of the landing position of ink droplets ejected through nozzles through which ink droplets with a liquid volume Vc of 0.7 ng increases to about double that of ink droplets ejected through nozzles through which ink droplets with a liquid volume Va of 2.8 ng are ejected. In connection with the improvement of print image quality, a higher landing accuracy is required for smaller ink droplets. Thus, designing the print head such that errors such as manufacturing tolerances can be absorbed is very important.

Thus, to account for manufacturing errors to reduce the amount of deviation of the landing position, the above-described embodiment sets the ratios of the opening area of the second ejection port portion S1*b* to the opening area of the first ejection port portion S1*a* such that the ratios meet the relationship in (Formula 1) as the ejection amount for the nozzles decreases.

$$S1b/S1a<S2b/S2a<S3b/S3a \quad \text{(Formula 1)}$$

It is assumed that the two types of nozzles with ejection amounts, one of which is about double the other, are formed in the same head substrate. In this case, when the openings of the first and second ejection port portions of one of the nozzles are defined as S1*a* and S1*b* and the openings of the first and second ejection port portions of the other nozzle are defined as S2*a* and S2*b*, then as a rule of thumb, the following relationship is preferably established.

$$S1b/S1a=\alpha\times S2b/S2a \ (\alpha>1,2)$$

In the above-described embodiments, the nozzles through which the three types of ink droplets, that is, the large, medium, and small ink droplets are ejected are arranged in the print head. However, the sizes of droplets are not limited to the three types, but may be two types, large and small, or four types, large, medium, small, and very small. Furthermore, the manner of arrangement of the ejection ports is not limited to the above-described embodiments. In short, the required relationship is such that the ratio of the opening area of the second ejection port portion to the opening area of the ejection port increases with decreasing opening area of the ejection port.

In the above-described embodiments, the inner surface of the ejection port portion change in two stages, that is, changes from the first ejection port portion to the second ejection port portion. However, the ejection port portion can be formed in more stages. That is, the ejection port portion can be formed in three or more stages. However, the ejection port portions positioned in the respective stages need to be formed such that the opening area increases from the ejection port to the position where the ejection port portion and the bubbling chamber communicate with each other.

Fourth Embodiment

Now, a fourth embodiment of the present invention will be described with reference to FIGS. 6, 7A, 7B, and 7C.

Figure 6:
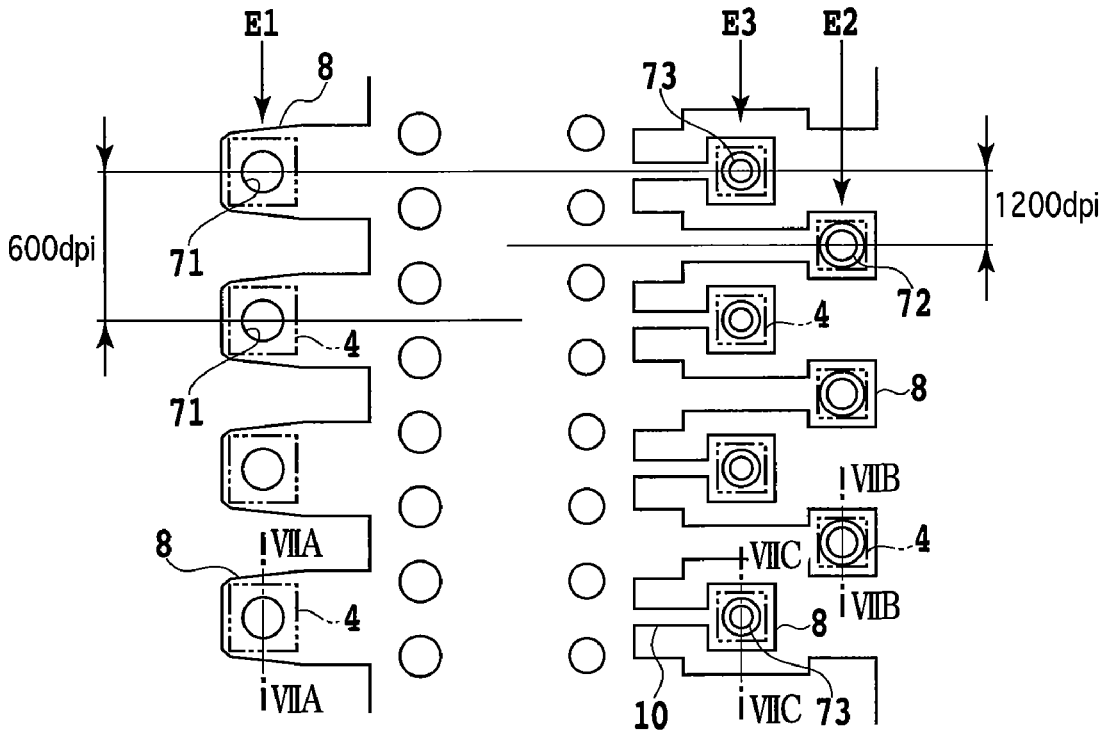
FIG. 6 is an enlarged bottom view showing a part of an ejection port array in an ink jet print head according to a fourth embodiment of the present invention.

FIG. 6 is an enlarged bottom view of a part of ejection port arrays in an ink jet print head according to the present embodiment. FIG. 6 shows the positional relationship among the ink supply channels 10, the electrothermal conversion elements 4, and the ejection ports 71, 72, and 73. In the fourth embodiment, as is the case with the first embodiment, the first ejection port array E1, made up of the large ejection ports 71, the second ejection port array E2, made up of the medium ejection ports 72, and the third ejection port array E3, made up of the small ejection ports 73, are arranged parallel to one another. In addition to the arrangement of the large, medium, and small ejection ports, the arrangements such as the bubbling chambers 9 and the ink supply channels 10 are similar to those in the first embodiment. However, the fourth embodiment differs from the first embodiment in the shape of the ejection port portion of each nozzle.

Figure 7C:
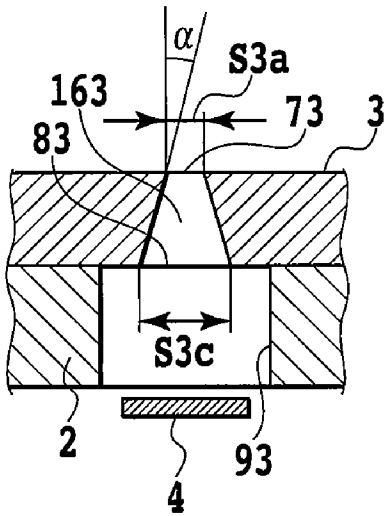
FIG. 7C is a sectional view of a small ejection port shown in FIG. 6, the view being taken along line VIIC-VIIC in FIG. 2.
Figure 7B:
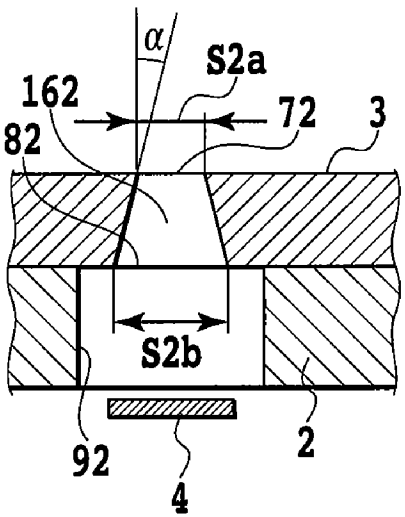
FIG. 7B is a sectional view of a medium ejection port shown in FIG. 6, the view being taken along line VIIB-VIIB in FIG. 6.
Figure 7A:
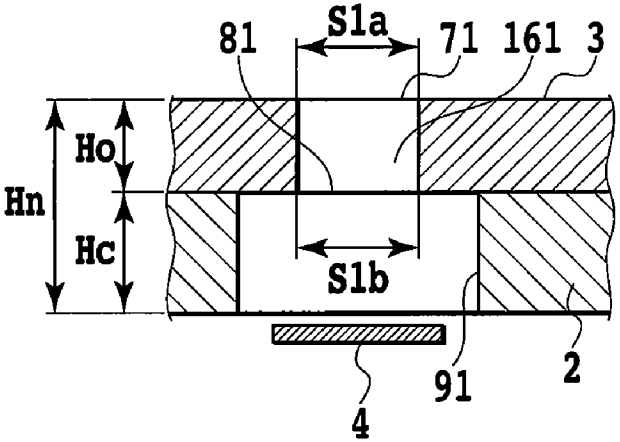
FIG. 7A is a sectional view of a large ejection port shown in FIG. 6, the view being taken along line VIIA-VIIA in FIG. 6.

FIG. 7A is a sectional view of the large ejection port shown in FIG. 6, the view being taken along line VIIA-VIIA in FIG. 6. FIG. 7B is a sectional view of the medium ejection port shown in FIG. 6, the view being taken along line VIIB-VIIB in FIG. 6. FIG. 7C is a sectional view of the small ejection port shown in FIG. 6, the view being taken along line VIIC-VIIC in FIG. 6.

In the first to third embodiments, the first and second ejection port portions are formed, with the step portion 31 formed in the boundary portion between the first and second ejection port portions. In contrast, inner surfaces of ejection port portions 161, 162, and 163 in the fourth embodiment are each formed of a continuous surface as shown in FIG. 7 and do not have the step proton 31 as is the case with the first to third embodiments. That is, the ejection port portion is not divided into the first and second ejection port portions as is the case with the first to third embodiments.

As shown in FIG. 7A, in the fourth embodiment, the ejection port portion 161 of the nozzle through which the large ink droplets are ejected forms a cylindrical space. The ejection port 71 and the bubble chamber-side opening 81 located opposite the ejection port 71 have the same diameter. In contrast, the ejection port portion 162 of the nozzle through which the medium ink droplets are ejected as shown in FIG. 7B and the ejection port portion 163 of the nozzle through which the small ink droplets are ejected as shown in FIG. 7C each form a conical space such that the area of the cross-section of the ejection port portion decreases continuously as the ejection port portion approaches the ejection port 72 or 73. Namely, both ejection port portions 162 and 163 are tapered and have a taper angle $\alpha$. The taper angle is desirably about 5 to 15°. In the fourth embodiment, the widths S1*c*, S2*c*, and S3*c* of the bubbling chambers 91, 92, and 93 communicating with the ejection port portions 71, 72, and 73 are in a relationship S1*c*>S2*c*>S3*c*. However, the bubbling chambers 91, 92, and 93 have the same height.

More specifically, the height Ho of the ejection port portion common to the large, medium, and small ink droplets is about 20 μm to 30 μm. The height Hc of the ink supply channel is about 10 μm to 20 μm. The diameter of the ejection port portion is at least about 11 μm for the large nozzle, about 8 μm to 11 μm for the medium nozzle, and about 5 μm to 8 μm for the small nozzle.

Thus, the fourth embodiment tapers the surfaces forming the ejection port portions 162 and 163 of the nozzles through which the medium and small ink droplets are ejected. The taper angle is $\alpha$. Thus, also in the present embodiment, the magnitude correlation between the ratios of the opening areas of the ejection port portion to the opening area of the ejection port is as follows.

$$S1b/S1a<S2b/S2a<S3b/S3a \quad \text{(Formula 1)}$$

That is, the ratio of the opening areas of the ejection port portion to the opening area of the ejection port is higher for the ejection port portion having the ejection port with the smaller opening area. Thus, the flow resistance in the ejection port portion can be reduced more sharply for the ejection port portion having the ejection port with the smaller opening area. That is, even for the ejection port portion having the ejection port with the smaller opening area, the rate of the loss of the pressure on the ink during ejection can be reduced. In the fourth embodiment, the inner surfaces of the ejection port portions 71, 72, and 73 are each continuous. The present embodiment can reduce the flow resistance to the ink compared to the first to third embodiments, having the step portion on the inner surface of the ejection port portion.

Thus, the present embodiment can keep acceptable the ink droplet ejecting capability, affected by alignment errors, and the ink sucking and discharging capability based on the suction recovery operation. Consequently, the fourth embodiment enables a drastic reduction in variation in ink droplet landing accuracy among the various nozzles. Moreover, the ejection port portion through which the large ink droplets are ejected is cylindrically shaped (this shape is hereinafter also referred to as a straight shape). This enables a reduction in the sum of the volumes of the ejection port portion and the bubbling chamber with respect to the liquid volume of the ejected ink droplets. This in turn enables a reduction in variation in the amount of ejected large droplets, which may result in notable density unevenness.

Figure 8:
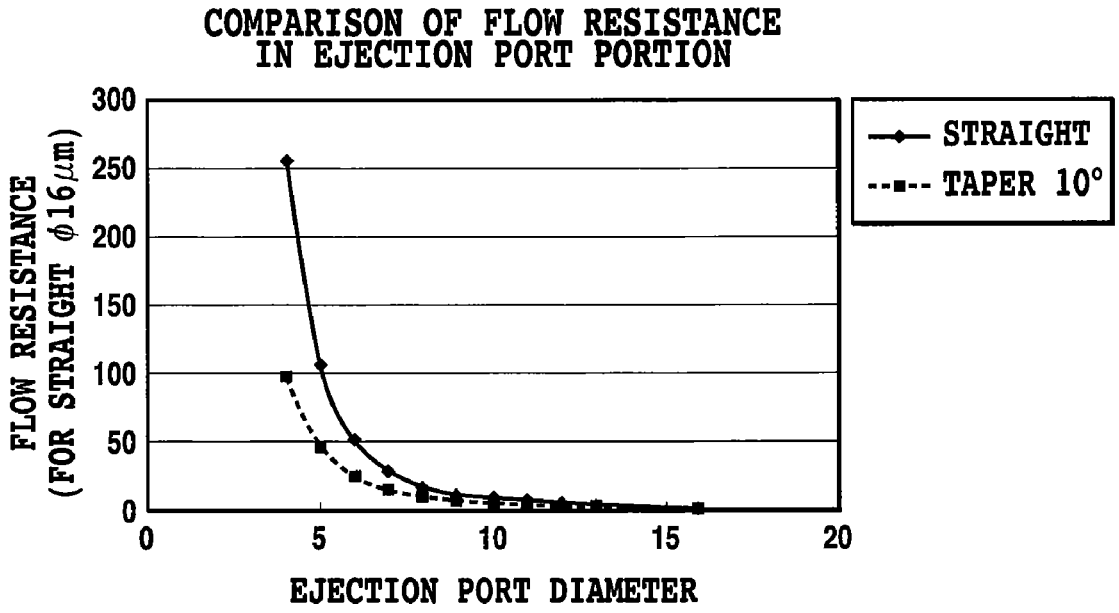
FIG. 8 is a diagram showing the relationship between ink flow resistance and ejection port diameter for each of a tapered ejection port portion and a cylindrical ejection port portion.

FIG. 8 shows the relationship between the ink flow resistance in each ejection port portion and the diameter of the ejection port for each of the tapered and cylindrical ejection port portions.

FIG. 8 shows the results of calculation of the flow resistance to the ink in each ejection port portion on the assumption that the height of the element substrate (the height of the bubble chamber) is 10 μm and the tapered ejection port has a taper angle of 10°. The flow resistance is 1 when the diameter of the cylindrical ejection port portion is 16 μm. The flow resistance of each ejection port portion is shown on the axis of ordinate. The ejection port diameter is shown on the axis of abscissa.

As shown in FIG. 8, for the cylindrical nozzle, the flow resistance to the ink in the ejection port portion increases rapidly with decreasing ejection port diameter; the rapid increase starts when the diameter is about 11 μm. In contrast, when the ejection port diameter is within the range from 11 μm to 4 μm, the flow resistance to the ink in the tapered ejection port portion is about 40 to 60% of that in the cylindrical ejection port portion. Furthermore, a smaller tapered ejection port more effectively reduces the ink flow resistance. For example, when the ejection port portion has a height of 10 μm, a viscosity resistance reducing effect based on a taper angle of 10° is about 30% at an ejection port diameter of 16 μm but increases to about 60% at an ejection port diameter of 4 μm.

Thus, the tapered ejection port portion enables a sharp reduction in ink flow resistance without the need to change the height (thickness) of the channel constituting substrate 3 or the height of the bubbling chamber even if the small ink droplets are ejected through the ejection port portion. Consequently, the ink droplets of all the sizes can be properly ejected by tapering the ejection port portions of the nozzles through which the medium and small ink droplets are ejected, as described above. This enables high-quality images to be formed by combining the ink droplets of all the sizes together.

Fifth Embodiment

A fifth embodiment of the present invention will be described.

Figure 9:
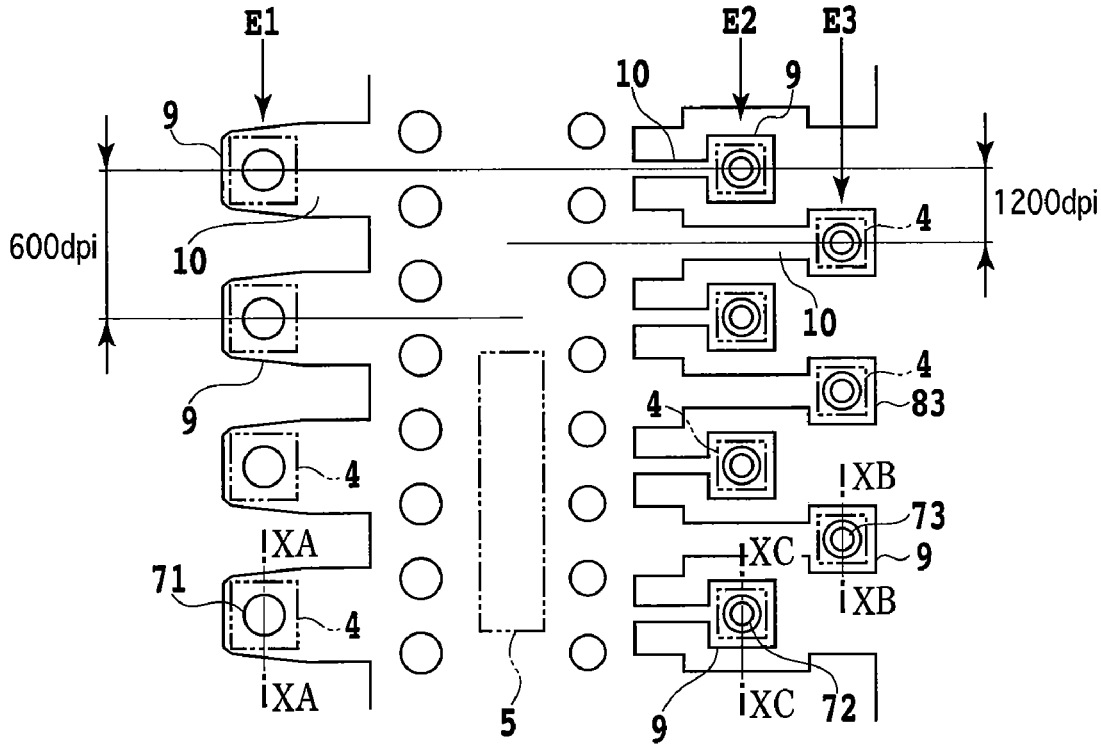
FIG. 9 is an enlarged bottom view showing a part of ejection port arrays in an ink jet print head according to a fifth embodiment of the present invention.

FIG. 9 is a bottom view of a part of ejection port arrays in an ink jet print head according to the present embodiment. FIG. 9 shows the positional relationship among the bubbling chambers 9, the ink supply channels 10, the electrothermal conversion elements 4, and the ejection ports 71, 72, and 73.

As shown in FIG. 9, in the fifth embodiment, the three ejection port arrays E1, E2, and E3 are arranged parallel to one another. The first ejection port array E1 is located on one side (in the figure, on the left side) of the ink supply port 5. The second and third ejection port arrays E2 and E3 are arranged on the other side (in the figure, on the right side) of the ink supply port 5. The first ejection port array E1 is composed of the plurality of large ejection ports 71. Each of the second and third ejection port arrays E2 and E3 is composed of the plurality of small ejection ports 72 and 73, respectively, through which the ink droplets of the same size (small ink droplets) are ejected. In the first ejection port array E1, the large ejection ports 71 are arranged at a pitch of 600 dpi in the ejection port arrangement direction. Consequently, the first ejection port array E1 forms the large dots at a density of 600 dpi in the ejection port arrangement direction. In contrast, each of the ejection ports (small ejection ports) 72 in the second ejection port array E2 is displaced from the corresponding ejection port 73 in the third ejection port array E3 by a distance corresponding to 1,200 dpi in the ejection port arrangement direction. Thus, the ejection port arrays E2 and E3 enable formation of the small dots at a density of 1,200 dpi in the ejection port arrangement direction, which is double the density of the large dots. Therefore, high-resolution images can be efficiently formed by combining the large and small ink droplets together.

Figure 10C:
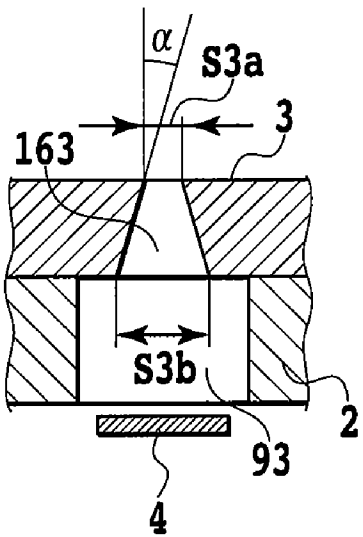
FIG. 10C is a sectional view of a small ejection port in a third ejection port array shown in FIG. 9, the view being taken along line XC-XC in FIG. 9.
Figure 10B:
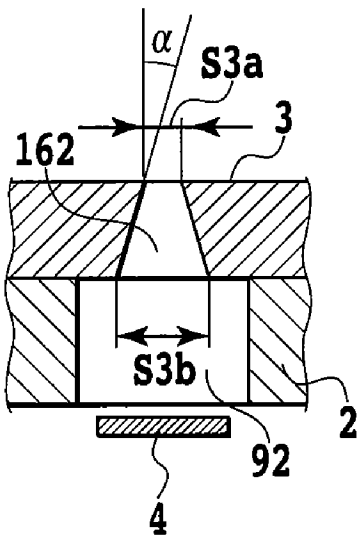
FIG. 10B is a sectional view of a medium ejection port in a second ejection port array shown in FIG. 9, the view being taken along line XB-XB in FIG. 9.
Figure 10A:
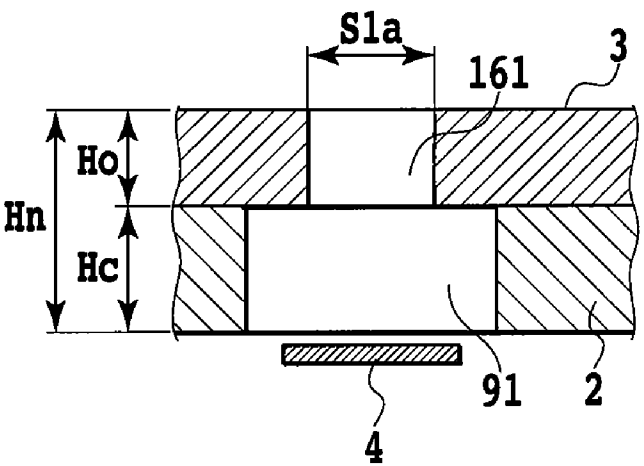
FIG. 10A is a sectional view of a large ejection port in a first ejection port array shown in FIG. 9, the view being taken along line XA-XA in FIG. 9.

FIG. 10A is a sectional view of the large ejection port in the first ejection port array shown in FIG. 9, the view being taken along line XA-XA in FIG. 9. FIG. 10B is a sectional view of the medium ejection port in the second ejection port array shown in FIG. 9, the view being taken along line XB-XB in FIG. 9. FIG. 10C is a sectional view of the small ejection port in the third ejection port array shown in FIG. 9, the view being taken along line XC-XC in FIG. 9.

As shown in FIG. 10A, the ejection port portion in the first nozzle array, forming the large dots, is substantially cylindrical. As shown in FIGS. 10B and 10C, ejection port portions 162 and 163 in the second and third nozzle arrays E2 and E3, respectively, forming the small dots, are tapered such that the sectional area of the ejection port portion decreases continuously as the ejection port portion approaches the ejection port. Each of the ejection port portions 162 and 163 has a taper angle $\alpha$ of about 5 to 15°. The nozzles have a nozzle height Hn of about 20 to 30 μm and an ink supply channel height Hc of 10 to 20 μm; these values are the same for all the nozzles. The large ejection port has a diameter of at least 11 μm. The small ejection port has a diameter of at least 5 μm and less than 11 μm. The other arrangements are similar to those of the fourth embodiment.

As described above, also in the fifth embodiment, the surfaces forming the ejection port portions 162 and 163 of the nozzles are tapered. Thus, also in the present embodiment, the magnitude correlation between the opening area S1*a*, S2*a*, S1*a* of the ejection port 71, 72, 73 and the opening area Sib, S2*b*, and S1*b* of the opening 81, 82, and 83 at the boundary portion between the ejection port portion 161, 162, 163 and the bubbling chamber 91, 92, 93 is as follows.

$$S1b/S1a < S2b/S2a = S3b/S3a$$

Therefore, the fifth embodiment can also properly maintain the ink droplet ejecting capability, affected by alignment errors, and the ink sucking and discharging capability based on the suction recovery operation. Consequently, the fifth embodiment enables a drastic reduction in variation in ink droplet landing accuracy among the various nozzles. Moreover, the ejection port portions 71, 72, and 73 have continuous inner surfaces without a step, enabling a reduction in the flow resistance to the ink. Furthermore, the ejection port portion through which the large ink droplets are ejected is cylindrically shaped, enabling a reduction in the ratio of the liquid volume of ejected ink droplets to the sum of the volumes of the ejection port portion and the bubbling chamber. This in turn enables a reduction in variation in the amount of ejected large droplets.

Sixth Embodiment

A sixth embodiment of the present invention will be described.

Figure 11:
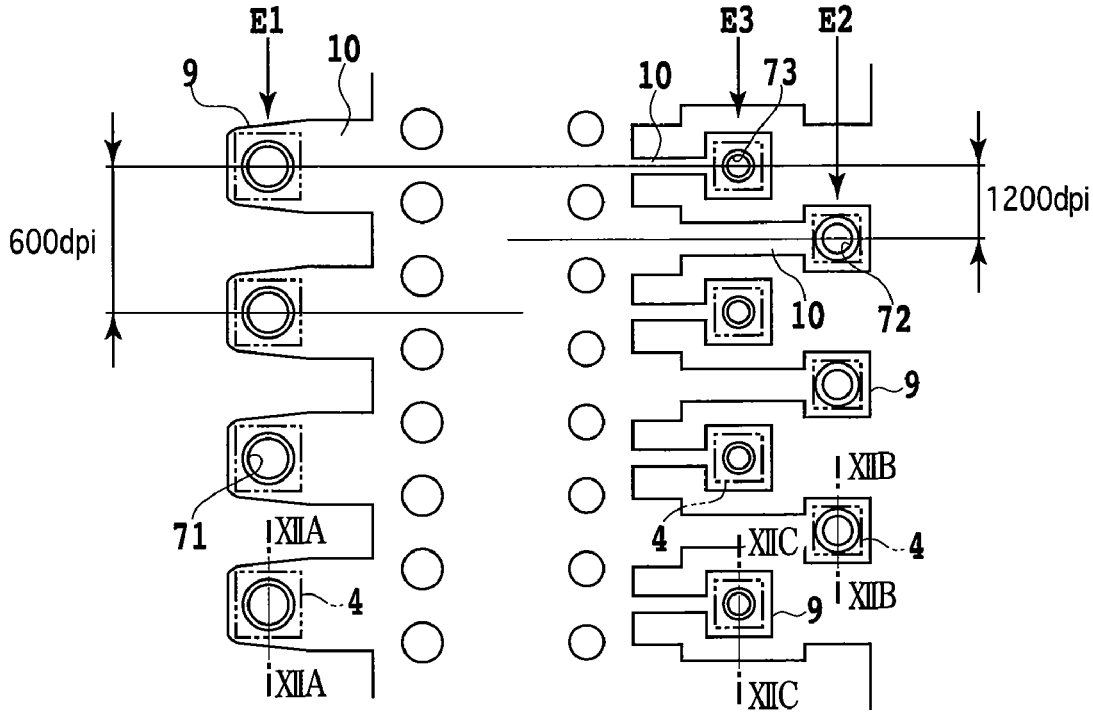
FIG. 11 is an enlarged bottom view showing a part of ejection port arrays in an ink jet print head according to a sixth embodiment of the present invention.
Figure 12C:
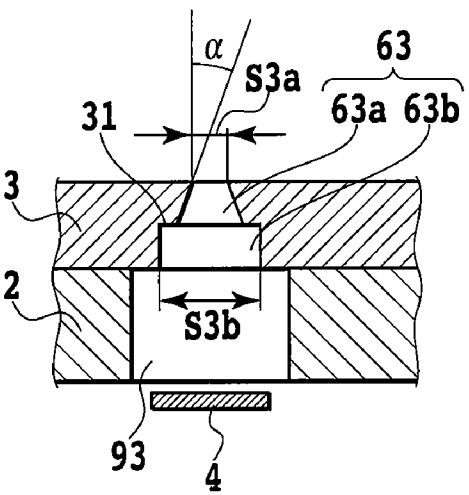
FIG. 12C is a sectional view of a small ejection port shown in FIG. 11, the view being taken along line XIIC-XIIC in FIG. 11.
Figure 12B:
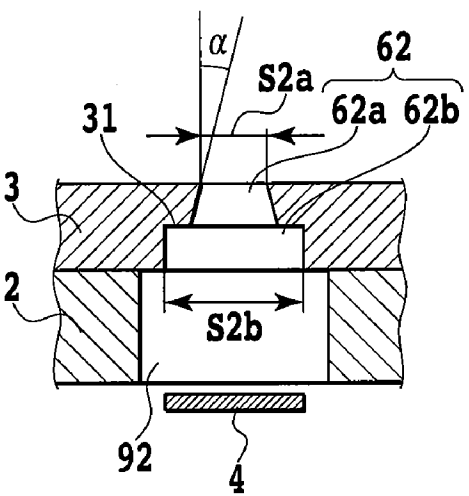
FIG. 12B is a sectional view of a medium ejection port shown in FIG. 11, the view being taken along line XIIB-XIIB in FIG. 11.
Figure 12A:
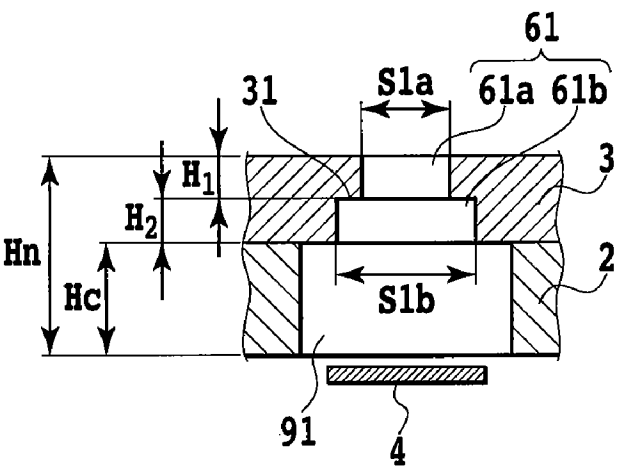
FIG. 12A is a sectional view of a large ejection port shown in FIG. 11, the view being taken along line XIIA-XIIA in FIG. 11.

FIG. 11 is a enlarged bottom view of a part of ejection port arrays in an ink jet print head according to the present embodiment. FIG. 11 shows the positional relationship among the bubbling chambers 9, the ink supply channels 10, the electrothermal conversion elements 4, and the ejection ports 71, 72, and 73. FIG. 12A is a sectional view of the large ejection port shown in FIG. 11, the view being taken along line XIIA-XIIA in FIG. 11. FIG. 12B is a sectional view of the medium ejection port shown in FIG. 11, the view being taken along line XIIB-XIIB in FIG. 11. FIG. 12C is a sectional view of the small ejection port shown in FIG. 11, the view being taken along line XIIC-XIIC in FIG. 11.

As shown in FIGS. 11, 12A, 12B, and 12C, like the above-described first embodiment, the sixth embodiment comprises the nozzles through which the large, medium, and small ink droplets are ejected and which have the ejection port portions 61, 62, and 63 each comprising the first ejection port portion 61*a*, 62*a* and 63*a* and the second ejection port portion 61*b*, 62*b* and 63*b*. However, the sixth embodiment is different from the first embodiment in that the first ejection port portion of each of the ejection port portions 62 and 63 is shaped like a cone having a sectional area decreasing continuously toward the ejection port (the first ejection port portion is tapered). The sixth embodiment is similar to the first embodiment in the other respects.

Thus, the first ejection port portions 62*a* and 63*a* of the ejection port portions 62 and 63, through which the medium and small ink droplets, respectively, are ejected, are tapered. The present embodiment can reduce the flow resistance to the ink compared to the first embodiment. The sixth embodiment can thus reduce the adverse effect of a possible manufacturing variation among the ejection port portions and improve the ink discharging capability associated with the suction recovery operation. As a result, high image quality can be achieved.

The present embodiment also forms the first and second ejection port portions to ensure the required thickness of the whole ejection port portion. The sixth embodiment can thus provide the ejection port portion with a physical strength higher than that in the fourth and fifth embodiments.

Seventh Embodiment

A seventh embodiment of the present invention will be described with reference to FIGS. 13, 14A, 14B, and 14C.

Figure 13:
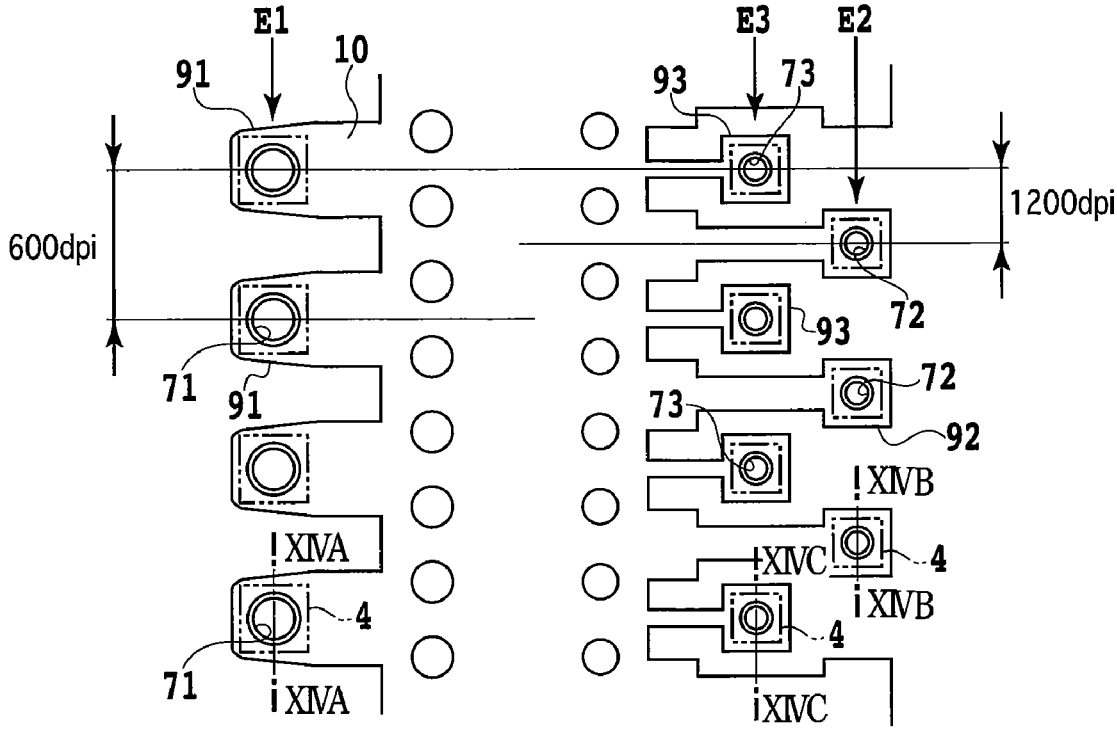
FIG. 13 is an enlarged bottom view showing a part of ejection port arrays in an ink jet print head according to a seventh embodiment of the present invention.
Figure 14C:
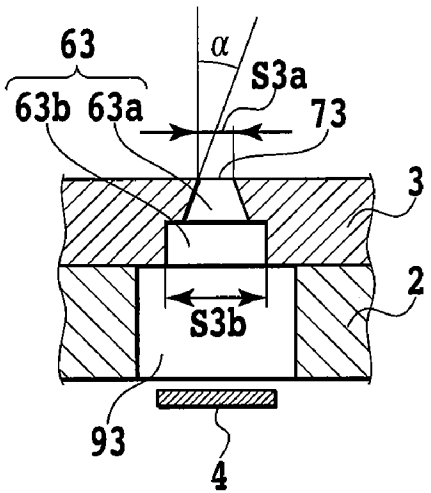
FIG. 14C is a sectional view of a small ejection port in a third ejection port array shown in FIG. 13, the view being taken along line XIVC-XIVC in FIG. 13.
Figure 14B:
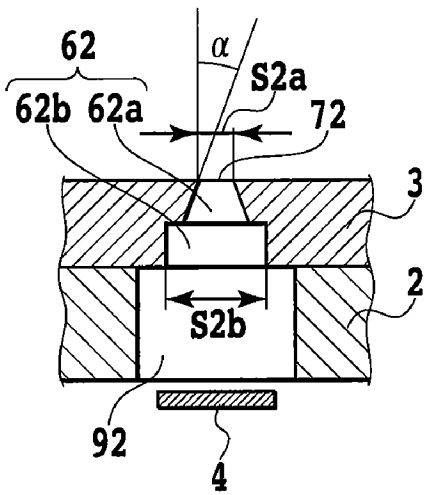
FIG. 14B is a sectional view of a medium ejection port in a second ejection port array shown in FIG. 13, the view being taken along line XIVB-XIVB in FIG. 13.
Figure 14A:
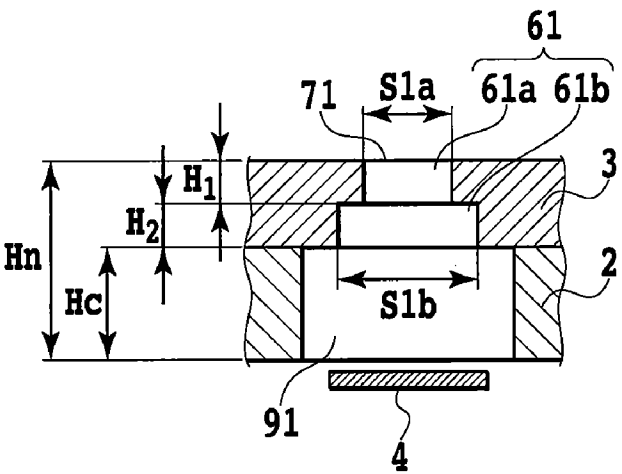
FIG. 14A is a sectional view of a large ejection port in a first ejection port array shown in FIG. 13, the view being taken along line XIVA-XIVA in FIG. 13.
Figure 15C:
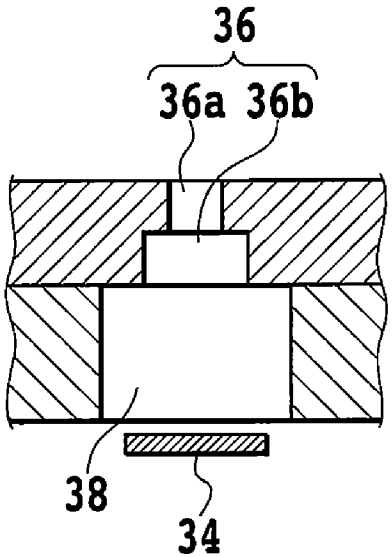
FIG. 15C is a vertically sectional side view of a small ejection port in a conventional ink print head.
Figure 15B:
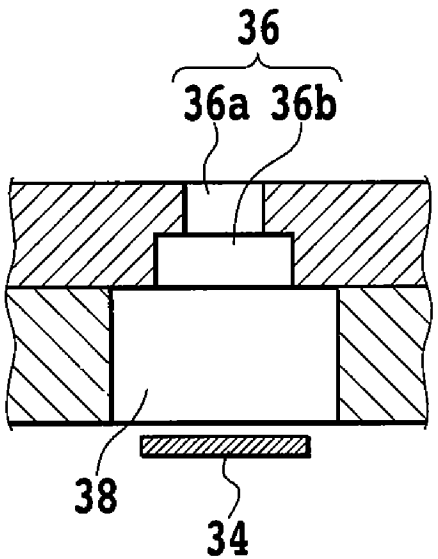
FIG. 15B is a vertically sectional side view of a medium ejection port in a conventional ink print head.
Figure 15A:
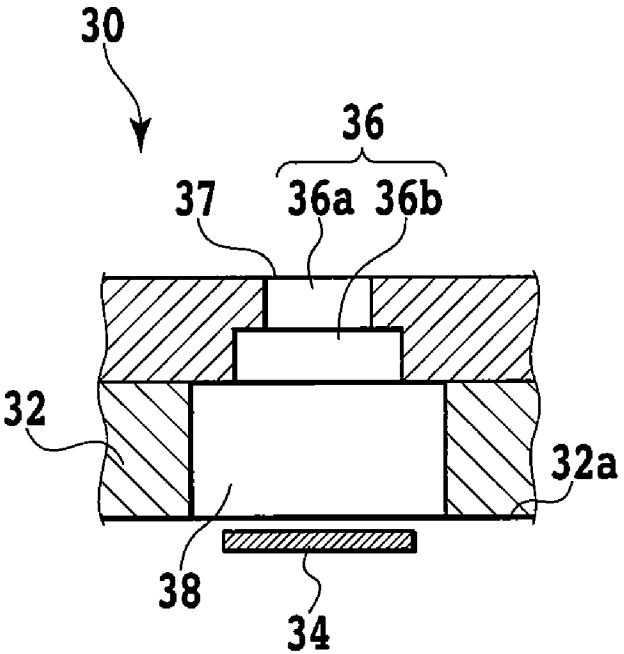
FIG. 15A is a vertically sectional side view of a large ejection port in a conventional ink print head.

FIG. 13 is a enlarged bottom view of a part of ejection port arrays in an ink jet print head according to the present embodiment. FIG. 13 shows the positional relationship among the bubbling chambers 9, the ink supply channels 10, the electrothermal conversion elements 4, and the ejection ports 61, 62, and 63. FIG. 14A is a sectional view of the large ejection port in the first ejection port array shown in FIG. 13, the view being taken along line XIVA-XIVA in FIG. 13. FIG. 14B is a sectional view of the medium ejection port in the second ejection port array shown in FIG. 13, the view being taken along line XIVB-XIVB in FIG. 13. FIG. 14C is a sectional view of the small ejection port in the third ejection port array shown in FIG. 13, the view being taken along line XIVC-XIVC in FIG. 13.

As shown in FIGS. 13 and 14, like the above-described sixth embodiment, the seventh embodiment comprises the nozzles through which the large and small ink droplets are ejected and which have the ejection port portions 71, 72, and 73 comprising the first ejection port portion 61, the second ejection port portion 62, and the third ejection port portion 63, respectively. However, in the seventh embodiment, the ejection port 73, constituting the third ejection port array E3, is a small ejection port having the same diameter as that of the ejection port 72, constituting the second ejection port array so that the second and third ejection port arrays E2 and E3 enable dots to be formed at a density of 1,200 dpi. This is similar to that for the fifth embodiment, shown in FIG. 9.

Therefore, the seventh embodiment is provided by merging the sixth and fifth embodiments. Thus, like the sixth embodiment, the seventh embodiment can reduce the adverse effect of a manufacturing variation among the ejection port portions and improve the ink discharging capability associated with the suction recovery operation and the physical strength of the ejection port portion. In addition to exerting these effects, the seventh embodiment, like the fifth embodiment, can form high-resolution images using the small ink droplets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-225812, filed Aug. 31, 2007, and No. 2008-192227, filed Jul. 25, 2008, which are hereby incorporated by reference herein in their entirety.

What is claimed is:

1. An ink jet print head comprising:

a first nozzle through which a predetermined volume of ink is ejected;

a second nozzle through which is ejected a volume of ink which is larger than the volume of ink ejected through the first nozzle, wherein each of the first nozzle and the second nozzle includes:

an ink ejection port for ejecting ink, a bubbling chamber having an energy generation element which generates energy used for ejecting ink, the bubbling chamber being formed at a position corresponding to the ink ejection port, and an ink ejection port portion allowing the ejection port to communicate with the bubbling chamber, wherein each of the first nozzle and the second nozzle has the following relationship: an opening area, in a direction orthogonal to an ejection direction of ink, of the ejection port is equal to or smaller than an opening area, in the direction orthogonal to the ejection direction of ink, of the ejection port portion at the position where the ejection port portion and the bubbling chamber communicate with each other, and wherein a ratio of the opening area of the ejection port portion to the opening area of the ejection port in the first nozzle is greater than a ratio of the opening area of the ejection port portion to the opening area of the ejection port in the second nozzle.

2. The ink jet print head according to claim 1, wherein each ejection port portion comprises a plurality of ejection port portion sections, such that the opening areas of the ejection port portion sections increase step by step to a position where the ejection port portion and the bubbling chamber communicate with each other.

3. The ink jet print head according to claim 1, further comprising a third nozzle through which is ejected a volume of ink which is larger than a volume of ink ejected through the second nozzle, wherein the opening areas of the ejection ports of the first, second, and third nozzles are defined as S1*a*, S2*a*, S3*a*, respectively, the opening areas of the ejection port portions of the first, second, and third nozzles are defined as S1*b*, S2*b*, S3*b*, respectively, and the following relationship between S3*a*, S2*a*, S1*a*, S3*b*, S2*b*, and S1*b* is satisfied:

$$S3b/S3a > S2b/S2a > S1b/S1a.$$

4. The ink jet print head according to claim 3, wherein the ejection port portion of at least the first nozzle has a sectional area increasing continuously toward a position where the bubbling chamber and the ejection port portion communicate with each other.

5. The ink jet print head according to claim 4, wherein a taper angle of the ejection port portion in the first nozzle is greater than a taper angle of the ejection port portion in the third nozzle.

* * * * *